US006622844B2

(12) United States Patent
Bolen

(10) Patent No.: US 6,622,844 B2
(45) Date of Patent: Sep. 23, 2003

(54) VENDING MACHINE WITH IMPROVED COIN BOX AND SUPPLEMENTAL BASE SUPPORT FOR UNLOADING ACCESS TO THE BOX

(76) Inventor: Richard K. Bolen, 4000 Clubhouse Dr., Champaign, IL (US) 61822

( * ) Notice: Subject to any disclaimer, the term of this patent is extended or adjusted under 35 U.S.C. 154(b) by 98 days.

(21) Appl. No.: 09/965,999

(22) Filed: Sep. 28, 2001

(65) Prior Publication Data

US 2003/0062244 A1 Apr. 3, 2003

(51) Int. Cl.[7] ..... G07F 9/06
(52) U.S. Cl. ..... 194/350
(58) Field of Search ..... 194/236, 255, 194/350, 237, 258, 292; 232/15, 16

(56) References Cited

U.S. PATENT DOCUMENTS 2,537,317 A * 1/1951 Probasco ..... 222/153.03
5,190,133 A * 3/1993 Bolen ..... 194/350
5,467,858 A * 11/1995 Kovens et al. ..... 194/350

* cited by examiner

*Primary Examiner*—F. J. Bartuska
(74) *Attorney, Agent, or Firm*—Lewis T. Steadman

(57) ABSTRACT

A bulk vending machine with a rigid base supporting a case with a merchandise storage container thereon, wherein upstanding supports on the base are provided with resting surface to support the case and container in a secure resting condition thereby providing access to the base and any coin tray therein and to permit easy coin removal, and incorporating a substantially maximized coin tray footprint, while applying an assembly securing force at the center of a top cover on the container and rearwardly of the center of the base.

6 Claims, 2 Drawing Sheets

VENDING MACHINE WITH IMPROVED COIN BOX AND SUPPLEMENTAL BASE SUPPORT FOR UNLOADING ACCESS TO THE BOX

BACKGROUND OF THE INVENTION

This invention relates generally to coin operated bulk vending machines of the type commonly encountered for dispensing gun, candy, toys or the like. More particularly, the invention relates to bulk vending machines of the type commonly known as the Northwestern Corporation Model 60, and machines similar thereto marketed by others in the bulk vending industry. The prior vending machines such as the Model 60 generally comprise a base which supports a hollow case which in turn supports a merchandise container resting on the upper part of the case. The case houses a coin operated mechanism which controls the receipt of coins for the dispensed product, and controls the dispensing of the product following receipt of sufficient coinage. A fixed elongated rod extending upwards from the base of the vending machine through the hollow case and thence through the merchandise container and the top cover for the merchandise container, secures the components together. The rod is typically provided with a lock member associated with the top cover that screws onto the upper end of the rod and, when tightened, and the key removed, secures the base, the case and the merchandise container in a tight, secure, vending machine assembly.

In such prior vending machines rotation of the rotary coin mechanism handle, positioned at the front of the case, would activate the rotary product dispensing wheel in the merchandise container and deposit the coin that permitted the actuation, in the bottom of the base. In some vending machines, such as the Model 60 above noted, the coins are deposited loosely into the base of the machine and are scooped manually from their position in the base. When the change was to be removed, the locking retainer was unlocked and the combined case and merchandise container were moved upwardly by the operator, exposing the front of the base containing the change. The change was then manually removed from the base by scooping it with the hand. In most situations the base was rigidly secured to a mounting bracket, either as a single machine or oftentimes as one of a large group of machines rigidly fixed together. As a practical matter, it was very difficult to collect the coinage in the manner described above, because a single operator is faced with picking up the combined case and container unit with one hand while scooping coinage from the base member with the other hand. This problem was addressed in U.S. Pat. No. 5,467,858 where a structure was described that provided for pivotal motion of the combined case and merchandise container, when in the uppermost position. There, the base and case unit were constructed to permit such a rotation about, essentially, the vertical center axis of the machine, and then resting the combined case and merchandise container unit on rails that formed a part of the base unit. However, this remedy does not work in situations where a plurality of vending machines are mounted side by side on fixed basis, or in other situations where the machine is positioned in close quarters. In such cases, there simply is not enough room to permit the rotation of the case and container elements relative to the base.

Other prior art devices provided no separately accessible coin box and required complete disassembly of the case and merchandise container in order to service the vending machine.

SUMMARY OF THE INVENTION

The present invention provides a bulk vending structure that allows vertical movement of the case and container, combined with a very slight forward movement thereof that does not require more side-to-side space than an unmodified type 60 machine, but does provide access to a separate, easily accessible coin box in the base.

Further, as a result of a reconfiguration of a separable coin box positioned in the base, the lifting and resting of the case and merchandise container without turning, provides for simple access to the coin box so that the coin box may be physically removed from the frame without difficulty or, alternatively, the operator can remove coins from the coin box while it is resting in the base. Reconfiguration and rearrangement of the assembly rod through an off center position in the base has provided a coin box of maximum foot print and hence maximum capacity.

The resulting vending machine has proven to be substantially more efficient than anything known in the prior art.

BRIEF DESCRIPTION OF THE DRAWINGS

The purpose and operation of the vending machine constituted in accordance with the present invention may readily be understood from the accompanying drawings of a preferred embodiment of the invention.

DETAILED DESCRIPTION OF THE PREFERRED EMBODIMENTS

Figure 1:
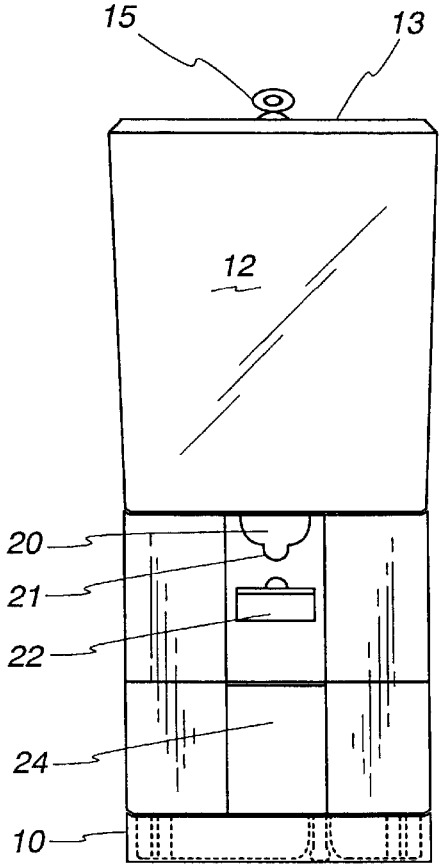
FIG. 1 is a front elevational view of a vending machine constructed in accordance with the present invention.

FIG. 1 illustrates a frontal elevational view of a long, popular vending machine such as those designated the Northwestern Corporation Model 60 manufactured by Northwestern Corporation of Morris, Ill. In the outward appearance of the machine as shown in FIG. 1, the machine appears identical to many prior art machines. The components there shown, comprise a base 10, a case 11, resting on the base and a merchandise container 12 resting, in turn, upon the case. A vertically extending internal rod 14 secured to the base projects up through the machine to a locking element 15 positioned in the container cover, or top 13. When the locking element 15 is removed, the case 11, with container 12 can be lifted as a combined unit, above the base 10, allowing the vending machine operator to scoop out coinage lying in the base, within the case 11 when the latter is in fully assembled condition with the container. Conventionally, the coin mechanism 20 permits insertion of the coinage into the mechanism at 21. With the proper coin in the mechanism 20, turning the hand crank 22 causes a coin inserted at 21 to be deposited downwardly into the base. Such rotation of the hand crank 22 rotates the product dispensing wheel causing merchandise in the merchandise container 12 to drop downwardly and forwardly to exit through the merchandise chute 24 into the customers hand.

Figure 2:
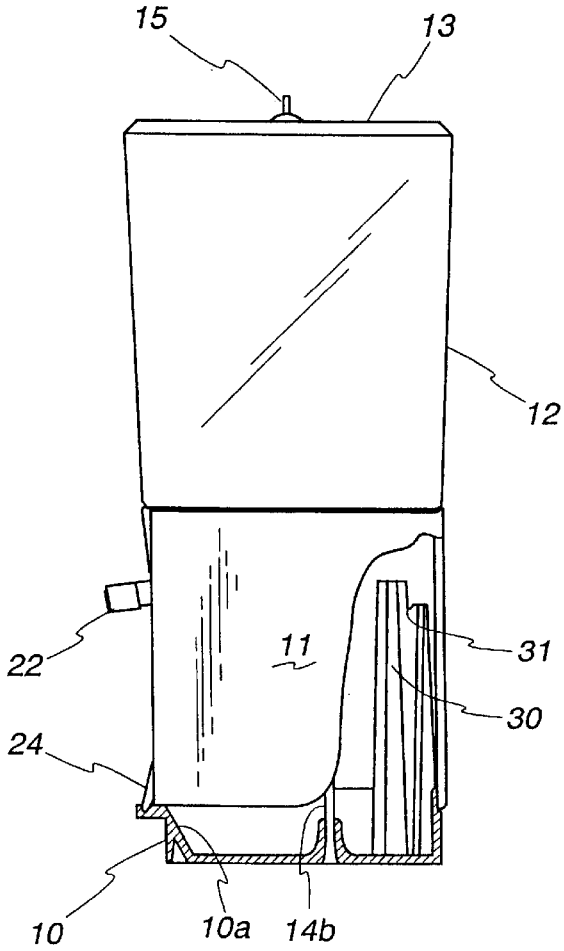
FIG. 2 is a side elevational view, from the right, of the vending machine shown in FIG. 1.
Figure 4:
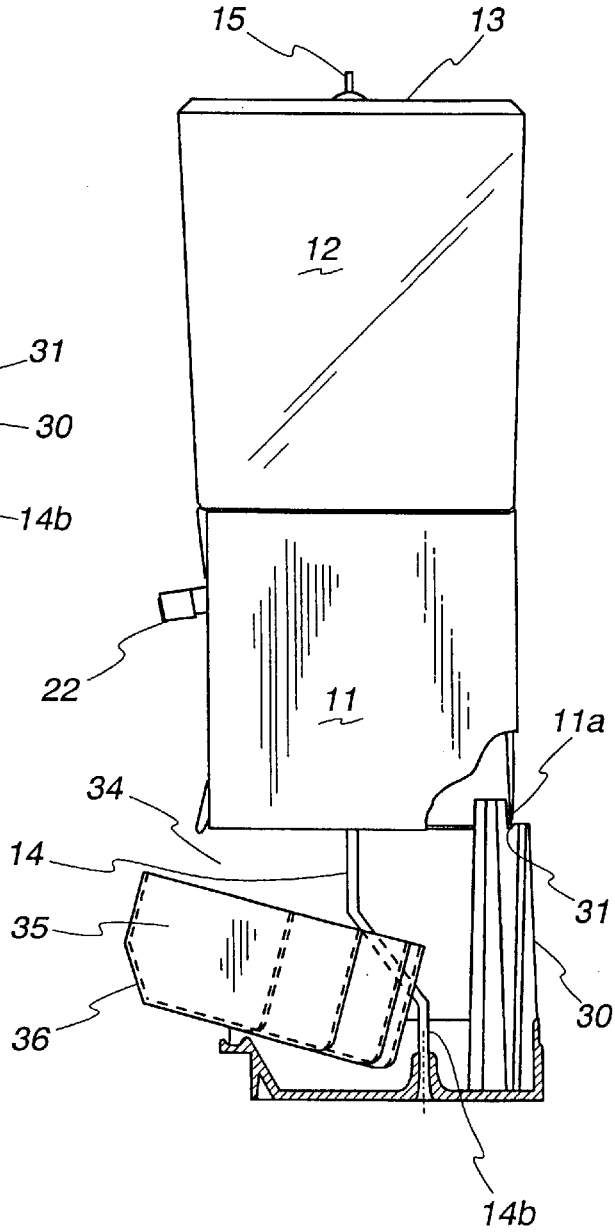
FIG. 4 is a side elevational view, from the right, of the vending machine in its raised, resting, condition with the coin tray moved upwardly and forwardly.

In accordance with the present invention, however, the construction of the interior components of the prior art Model 60 illustrated in FIG. 1, are different. As can be seen from the partial cross-sectional side elevational view of FIG. 2, the base of the present, improved, machine is shown as having a pair of upstanding legs 30 constructed integrally with the base 10. At the upper end of each of the legs 30, and at the rear most edge thereof, is a vertically open notch 31, When the locking element 15 is removed from the rod 14, the case 11, with container 12, may be manually lifted as an assembly and the rear most edge 11(*a*) of the case, which comprises, typically, a sheet metal member, may be lowered into the notches 31, and the hand of the operator removed from support of the case 11. At this point, the apparatus is as illustrated in FIG. 4, with a substantial space 34 showing between the bottom of the case 10 and the top of the coin tray 35. At this juncture, the coin tray 35 may, as shown, be lifted vertically and slid forwardly toward the operator to remove it from the confines of the machine. In this condition, the coins of the tray may be dumped into a coin satchel or other removal container. Alternatively, of course with the large access opening 34, the operator may scoop the coinage from the coin tray, in situ.

Figure 3:
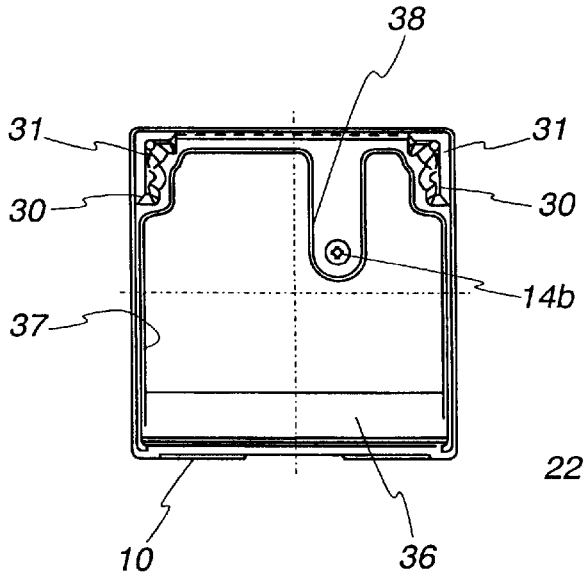
FIG. 3 is a plan view of the coin box resting in the frame of the vending machine.

As can be seen from consideration of the coin box plan view shown in FIG. 3, and the side view in FIG. 4, the coin box has an angled front wall 36 and is, otherwise, straight sided as at 37.

Continuing, the front wall 36 of the coin box, or tray, lies adjacent, and conforms to, the angled front wall 10(*a*) of the base 10. With this arrangement, the loss or destruction of the coin box will not render the vending machine inoperative since the coins can readily be scooped, with both hands if desired, while the case 11 rests in the notches 31 as shown in FIG. 4.

In accordance with a preferred embodiment of the present invention, the rod 14 is modified from similar rods provided in the prior art mechanisms, by providing an offset lower end 14*b*. By providing the offset, the coin box can, as shown in FIG. 3 be maximized in its footprint, with the notch 38 of the coin box extending substantially less than to the center of the coin box, as in the prior art. As shown in FIG. 3, the rod end 14*b* is positioned substantially to the rear and to the side of the base. In practice I have found that the offset of the rod may amount to one inch or more in cases such as ordinarily employed having a base width and depth approximating six inches. It will be understood that the utilization of a notched coin tray is not, broadly, a part of my invention. Such trays, employing a notch going somewhat beyond the center of the tray, were described in the above-noted U.S. Pat. No. 5,467,858, and have been used in commerce prior to that patent in Northwestern Corporation's "triple play" machine illustrated in its U.S. Pat. No. 5,190,133. (Although the patent did not show the coin tray that was commercially, associated with the centrally located assembly rod 34).

From the above description, it will be understood that I have provided a substantially simplified and improved vending machine which provides improved access to the merchandise-generated coinage, and which provides additional space for the coinage itself. While other variations will readily occur to those skilled in the art from consideration of the specification and drawings hereof, it is my intent that the scope of the invention be limited solely by that of the hereinafter appended claims.

I claim:

1. A bulk vending machine having a base, a merchandise container having a cover, a case supporting said container on said base, said base providing a receptacle for coins collected for the merchandise vended, said base having at the periphery thereof an upstanding support providing generally horizontal support surface for cooperation with the lower edge of the rear side wall of the case when the case is raised vertically upwardly, horizontally and then downwardly, a distance above the base, to temporarily support the case and the container in an upright position spaced above the base and thereby provide access to the base.

2. A bulk vending machine in accordance with claim 1 wherein the support surface comprises a vertically open notch.

3. A bulk vending machine in accordance with claim 2 wherein the upstanding support comprises a plurality of upstanding support members each having an upwardly open notch.

4. A bulk vending machine in accordance with claims 3 wherein the upwardly opening notches are at the rear of the case and cooperate with the rear side wall of the case and the rear inside surface of the case.

5. A bulk vending machine as set forth in claim 1 wherein a vertically extending horizontally offset rod is secured to the base rearwardly of the center thereof and extends upwardly forwardly through said case and container into lockable association with said cover at substantially the center thereof to tightly position and secure said base, case, container and top together in a balanced manner.

6. The structure of claim 5 wherein a coin tray is positioned on said base within said case and is forwardly removable from association therewith when said case is resting on said support surface, said tray having a cut out walled slot extending from the rear thereof to a point substantially to the rear of the center of the bottom of the tray and of the base when the tray is assembled thereon.

* * * * *